United States Patent [19]

Gramse et al.

[11] Patent Number: 4,841,876

[45] Date of Patent: Jun. 27, 1989

[54] RAILROAD CONTAINER TRANSPORTING CAR OF INCREASED WEIGHT CARRYING CAPACITY

[75] Inventors: Harold E. Gramse; Richard E. Jamrozy, both of Lansing, Ill.; James M. Wilczynski, Highland, Ind.

[73] Assignee: Thrall Car Manufacturing Company, Chicago Heights, Ill.

[21] Appl. No.: 199,464

[22] Filed: May 27, 1988

[51] Int. Cl.[4] ..... B61D 17/00

[52] U.S. Cl. ..... 105/406.1; 105/4.1; 105/421

[58] Field of Search ..... 105/3, 4.1, 4.2, 406.1, 105/421, 419

[56] References Cited

U.S. PATENT DOCUMENTS

| | | | |
|---|---|---|---|
| 934,383 | 9/1904 | Becker | 105/419 |
| 3,357,371 | 12/1967 | Gutridge | 410/54 |
| 4,750,431 | 6/1988 | Yates et al. | 105/4.1 |

*Primary Examiner*—Johnny D. Cherry
*Assistant Examiner*—Gary C. Hoge
*Attorney, Agent, or Firm*—Marshall, O'Toole, Gerstein, Murray & Bicknell

[57] ABSTRACT

A railroad car for transporting horizontal shipping containers, the car having a novel stub center sill extending from a coupler to the end wall of a well portion capable of receiving one or more shipping containers, (2) a reinforcement assembly from the coupler to the end sill, (3) a reinforcement of the car body central portion so that it can transport two end-to-end abutting containers in the well and (4) lateral car body side wall tie braces having increased stiffness and which are easily attached by fasteners.

36 Claims, 5 Drawing Sheets

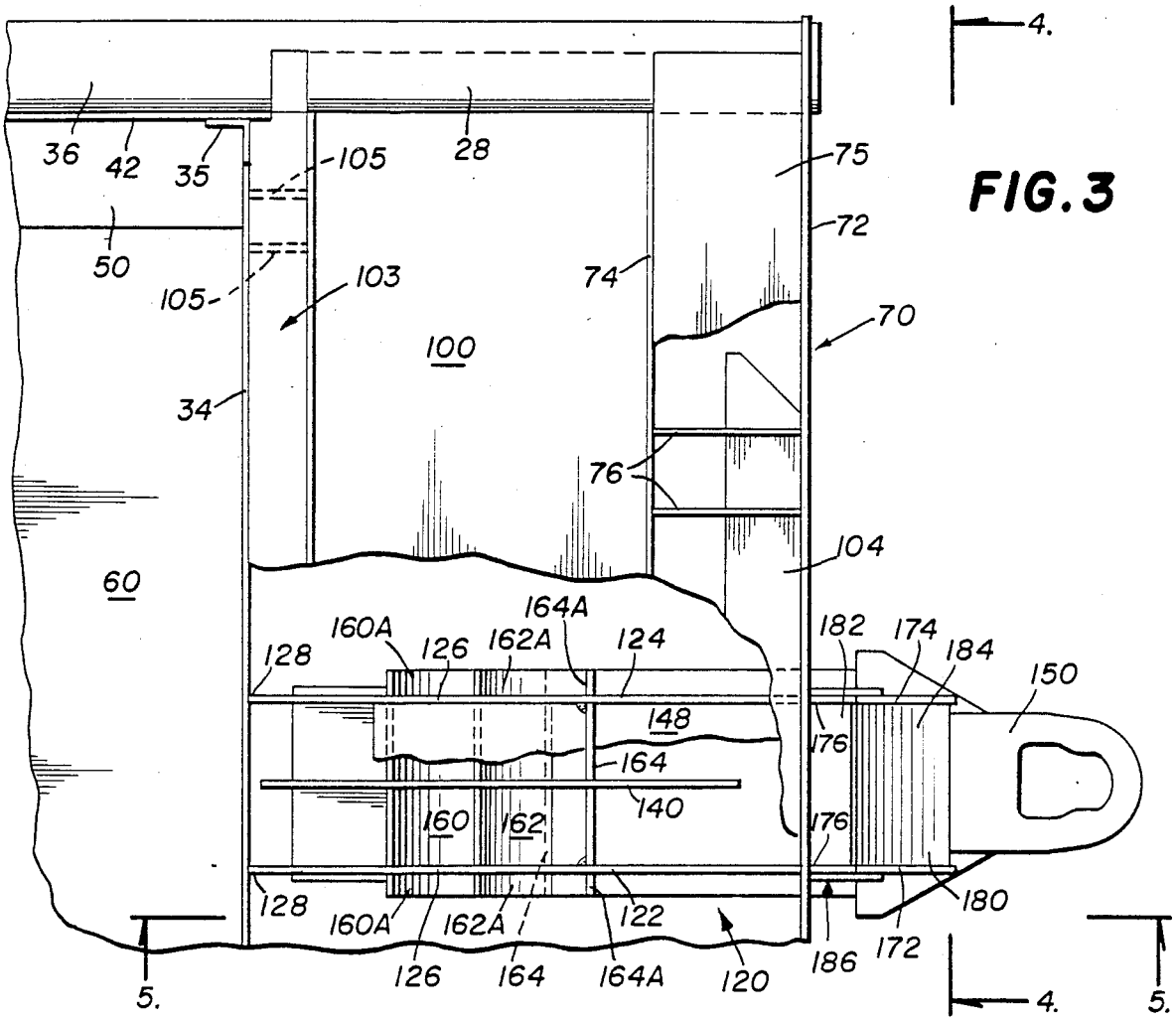
FIG. 3
FIG. 4
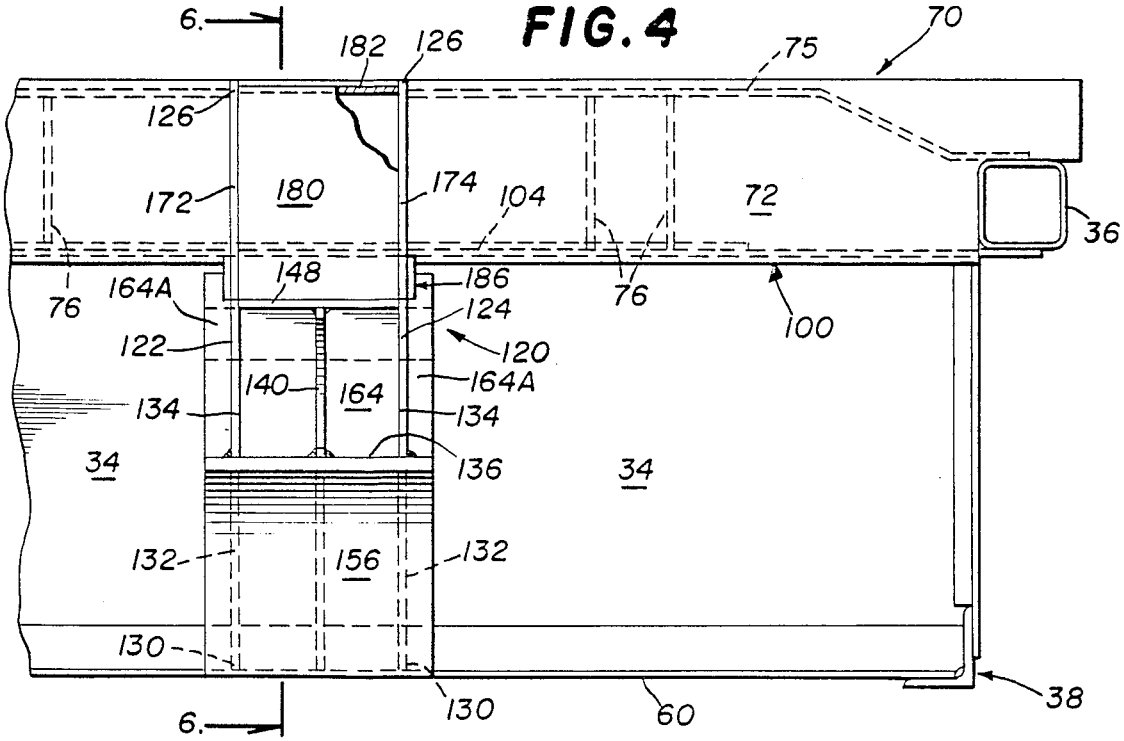

FIG. 5
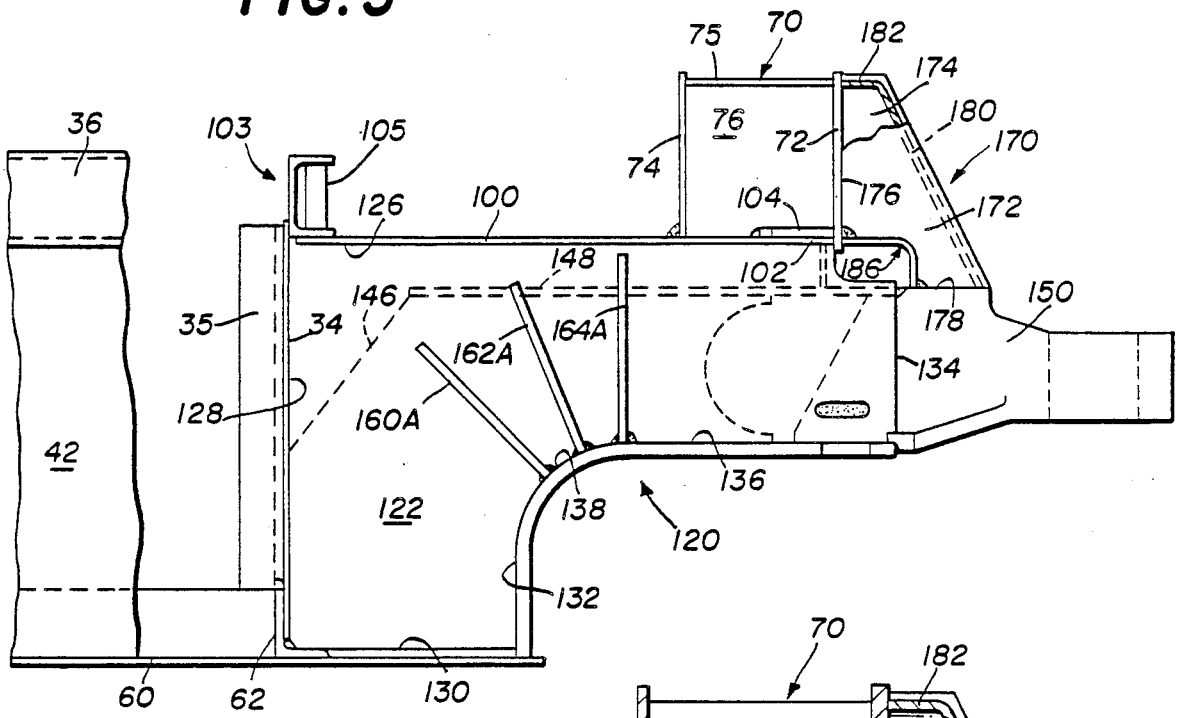
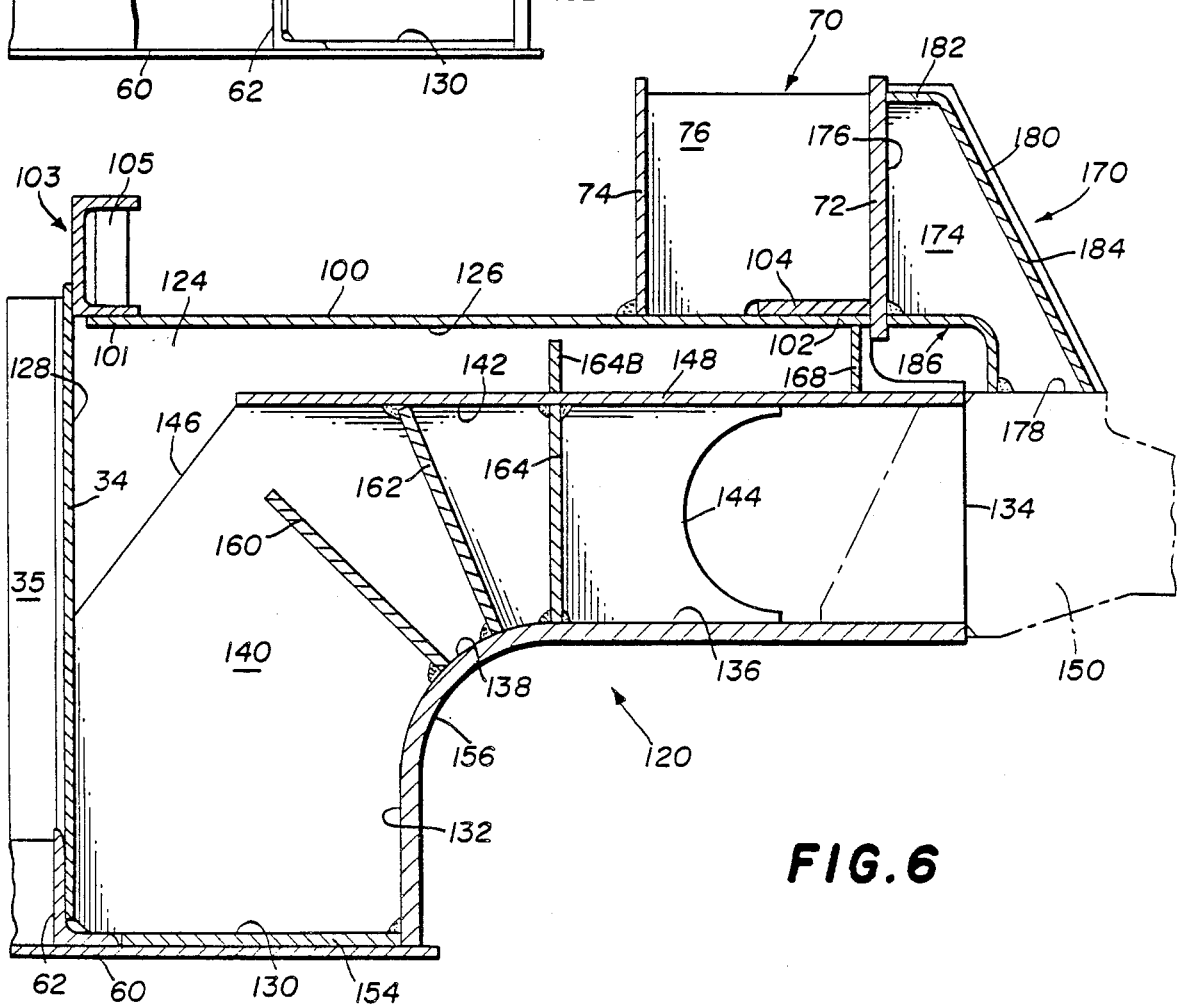
FIG. 6

RAILROAD CONTAINER TRANSPORTING CAR OF INCREASED WEIGHT CARRYING CAPACITY

This invention relates to railroad freight cars. More particularly, this invention is concerned with railroad freight cars which transport shipping containers in one or two layers.

BACKGROUND OF THE INVENTION

Freight shipping containers are widely used to transport a variety of goods and products on ships, barges, railroads and over-the-highway vehicles. Container transport is very efficient since it minimizes labor costs, damage to goods and products and reduces the opportunities for pilferage and vandalism.

Containers come in different but standardized lengths. The lengths most widely used at 20, 35, 40, 45 and 48 feet. To the extent possible, the railroad cars which transport containers must be able to accommodate as many different lengths of containers as possible.

One type of container car in use is referred to as a well car since it has a container-receiving well portion or space between car railway trucks at each end. The bottom of the well is generally at about the height of the wheel axles so that when one or more containers are placed end to end in the well they provide a low profile and a low center of gravity. This makes it possible to stack a container on top to form a double stack container load. When containers are double stacked, the total length of the top layer can be the same as or considerably longer than the first layer because the top layer can extend over the ends of the well and partially over the trucks. Representative of such cars are those disclosed in U.S. Pat. Nos. 4,624,188; 4,456,413; 4,091,742; and 3,357,371. Although the railroad cars disclosed in those patents for carrying containers perform reasonably well there is a desire to have even better cars available.

The copending patent application of Jamrozy et al. Ser. No. 074,341 filed July 16, 1987, discloses an improved container well car for transporting double stacked containers up to a maximum load of 100,000 to 103,000 pounds per well. That car has seen substantial commercial use and has performed very well. However, it was not designed for, and thus is not suitable for, some of the heavier loads up to 125,000 pounds per well which the railroads and shippers now desire to have container cars carry. Additionally, it was not found feasible to simply scale up the 100,000 pounds capacity well to strengthen it to carry loads of 125,000 pounds. A need was accordingly determined to exist for a new container well car capable of handling container loads of 125,000 pounds per well.

It is accordingly a primary purpose of this invention to provide a railroad car having a well portion for carrying shipping containers characterized by structural improvements which make it easier to manufacture, strong and light weight and capable of carrying loads up to 125,000 pounds.

SUMMARY OF THE INVENTION

A railroad car for transporting horizontal shipping containers is provided by this invention having at least one of a plurality of novel structural features disclosed herein. The novel structural features disclosed herein include at least (1) a novel container car stub center sill extending from a coupler to the end wall of a well portion capable of receiving one or more shipping containers, (2) a reinforcement assembly from the coupler to the end sill, (3) reinforcement of the car body central portion so that it can transport two end-to-end abutting containers in the well and (4) lateral car body side wall tie braces having increased stiffness and which are easily attached by fasteners. These and other novel structural features disclosed herein can be used singly or in any combination to produce a railroad container well car according to the invention.

More specifically, according to one aspect of the invention a railroad car for transporting a horizontal shipping container is provided comprising first and second railroad trucks supporting opposite ends of a railroad car body; the car body having a well portion, defined in part by low longitudinal side walls and lateral end walls, which supports one or more horizontal longitudinally positioned containers; a stub center sill at each end of the car body; each stub center sill being joined at one end to an adjacent well end wall with the other end of the stub center sill having coupler means to couple the car to another car to make up a train; each stub center sill having a pair of spaced apart substantially identical side walls, a bottom edge extending forward from near the well end wall for a distance substantially less than the length of the stub center sill wall and terminating in an upwardly extending inner edge, a front end extending downward for a distance substantially less than the height of the stub center sill side wall and terminating in a rearwardly extending central edge, and an arced edge extending from the central edge to the inner edge; a vertical web spaced between the stub center sill side walls; a plate between and joined to the stub center sill side walls and joined to the vertical web top portion; a substantially horizontal plate, joined to the stub center sill side walls and the vertical web, adjacent the bottom edge; and a one piece curved angle plate joined to the vertical inner edges, the rearwardly extending central edges and the arced edges of the stub center sill side walls.

Lateral spaced apart plates can be positioned between the side walls and the vertical web and be joined to the curved angle plate at the curved portion thereof.

Each side of the car can have a top side sill which can extend beyond the end of the well portion to the end of the car body; an end sill can be at each end of the car body and joined to the ends of the top side sills; and a shear plate can be positioned on top of and be joined to each stub center sill, end sill, the top side sills and the well portion end wall.

A pair of spaced apart vertical plates longitudinal of the car can be joined to the end sill outer vertical lateral surface and to the coupler means and the vertical plates can be joined to an adjacent end sill. Desirably, at least one and desirably two lateral plates can extend between and be joined to the spaced apart vertical plates which are longitudinal of the car.

The coupler means can constitute a male or female element of an articulated coupler means, the male or female element can have a top surface and the spaced apart vertical plates which are longitudinal of the car can be joined to the top surface of the male or female element.

The well side walls can include a side sheet extending from the top side sill to the bottom side sill; the well side sills can have a vertical web joined to the side sheet and an inwardly directed flange; a pair of closely spaced apart vertical ribs can be located along the outside surface of the well side wall centrally located longitudinally of the well and joined to the top side sill and to the bottom side sill; and a reinforcing member having a longitudinal horizontal flange can be joined to the bottom of the well side sill flange and a longitudinal vertical web can be joined to the outside surface of the ribs, with the flange and web of said member joined together by an integral arced transition portion.

The lower ends of the ribs can be reinforced by vertical gusset plates on opposing lateral side surfaces and the said vertical gusset plates can be joined to the lower side sill and to the reinforcing member.

Each rib can be an identical straight channel member having all sides with parallel longitudinal edges and the open side of the channel member can be joined to the side wall sheet.

A plurality of spaced apart lateral lower side sill rectangular tubular tie braces can be operatively joined at their ends to opposing lower side sills with the tie brace ends having the lower horizontal web cut out to provide access for fasteners to be installed through the upper horizontal web and be joined to a plate joined to the lower side sill.

Two such tie braces can be positioned side-by-side and be joined together.

BRIEF DESCRIPTION OF THE DRAWINGS

FIG. 3 is a plan view, partially broken away, of one end of the car shown in FIGS. 1 and 2;

FIG. 4 is an end view, partially broken away, taken along the line 4—4 of FIG. 3;

FIG. 5 is a side elevational view of the stub center sill taken along the line 5—5 of FIG. 3;

FIG. 6 is a sectional view of the stub center sill taken along the line 6—6 of FIG. 4;

DETAILED DESCRIPTION OF THE DRAWINGS

To the extent it is reasonable and practical the same or similar elements which appear in the various views of the drawings will be identified by the same numbers.

Figure 1:
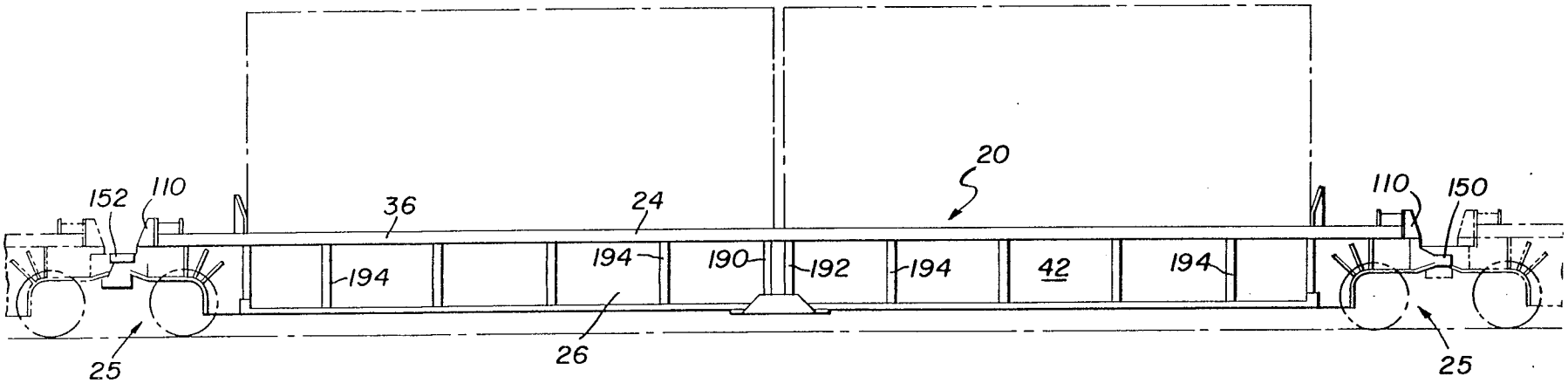
FIG. 1 is a side elevational view of one embodiment of a railroad car, according to the invention, for transporting horizontal double stacked shipping containers, shown in phantom.
Figure 2:
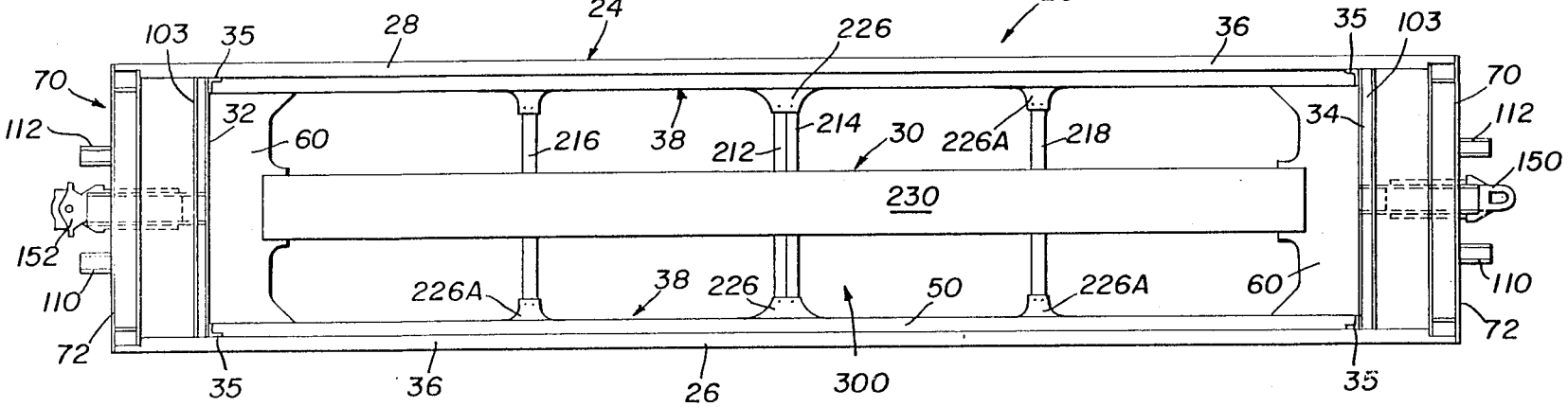
FIG. 2 is a plan view of the railroad car shown in FIG. 1.
Figure 7:
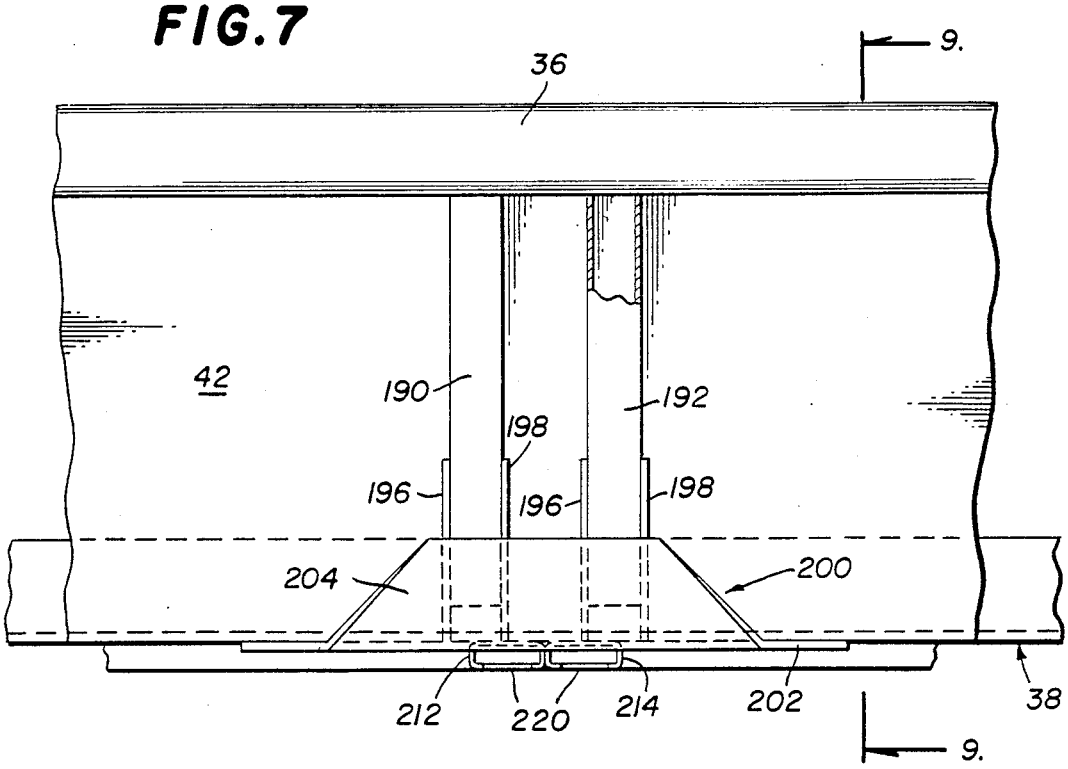
FIG. 7 is a side elevational view of the central portion of the car as shown in FIG. 1.

The railroad car 20 for transporting horizontal double stacked shipping containers shown in FIGS. 1 and 2 has a body 24 comprising a pair of opposing longitudinal low vertical side walls 26,28, a bottom or floor 30 and low vertical end walls 32,34 at each end of the car body extending between the body side walls 26,28. Vertical angle members 35 are located in the corners of the well where the side walls and end walls meet. Each end of the car body is supported by a railroad car truck 25 which may support only one car end or the car truck can support two adjacent car ends by means of an articulated coupling, such as shown in U.S. Pat. No. 3,646,604. The car shown in the drawings is provided with a male coupler portion 150 at one end and a female coupler portion 152 at the other end which on opposing ends of adjacent cars unite to form an articulated coupling.

The well space 300 defined by the two end walls 32,34 and the two side walls 26,28 can be dimensioned to hold one forty-feet long lower or bottom container or two twenty-feet long containers. An upper container can be positioned on top of the lower container(s) to form a double stack container load. Alternatively, the well can be sized forty-eight feet long to carry a forty, forty-five or forty-eight feet long container with a forty, forty-five, forty-eight or fifty-three feet long container on top.

Figure 9:
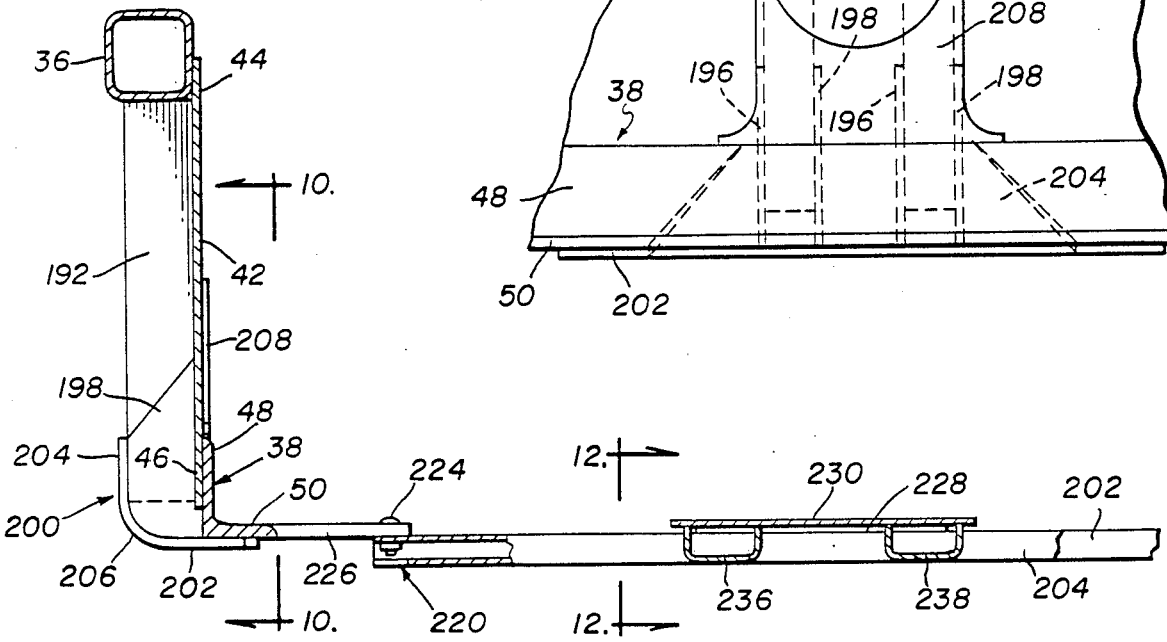
FIG. 9 is a sectional view taken along the line 9—9 of FIG. 7.
Figure 10:
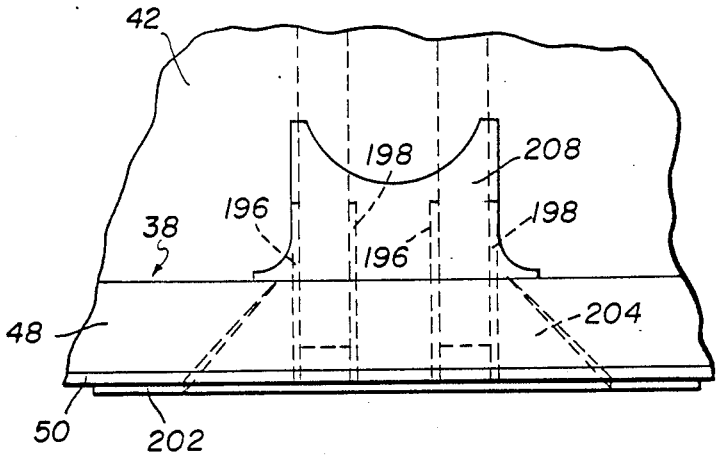
FIG. 10 is a view taken along the line 10—10 of FIG. 9 and shows the central portion of a car side wall from inside the well.
Figure 11:
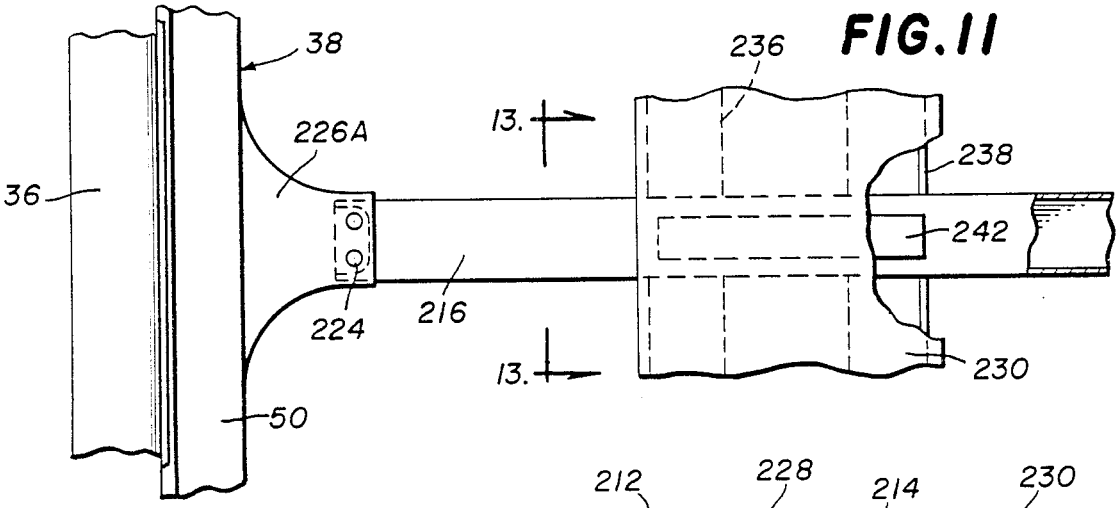
FIG. 11 is a plan view showing a portion of a single lateral tubular tie brace at the bottom of the well.
Figure 12:
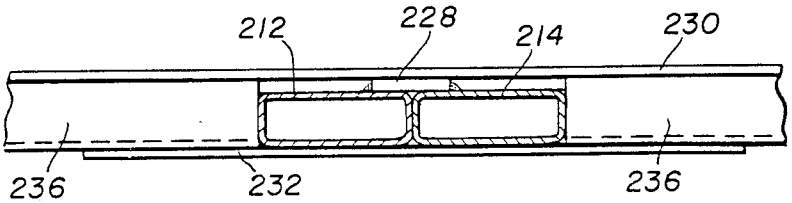
FIG. 12 is a sectional view taken along the line 12—12 of FIG. 9.
Figure 13:
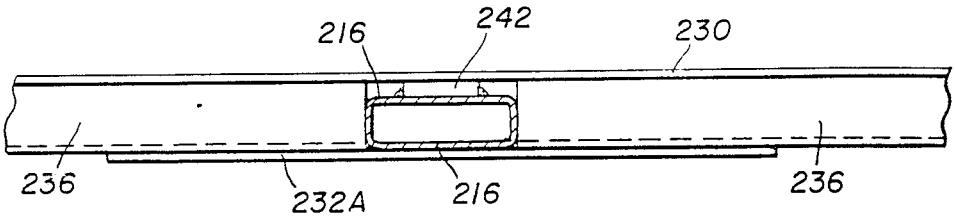
FIG. 13 is a sectional view taken along the line 13—13 of FIG. 11.

Each of the car body side walls 26,28 has a longitudinal square tubular top side sill 36 and an angle member bottom side sill 38. The bottom side sill 38 extends for the length of the well between end walls 32,34. The bottom side sill 38 has a horizontal flange 50 which is the primary support for containers in the well. The top side sills 36 extend for the full distance between the end sills 70 which are connected thereto. Each side wall 26,28 includes a vertical sheet or plate 42 having its longitudinal top side edge portion 44 joined to the inner side of top side sill 36. The longitudinal bottom side edge portion 46 of side wall sheet 42 is joined to the side of web or leg 48 of the angle side sill 38 (FIG. 9).

A shear plate 60 is positioned laterally in each bottom end portion of the car well 300 and the opposing edges of the shear plate 60 are joined to the outer edge of flange 50 of each angle member side sill 38. The lateral outer edge of shear plate 60 is joined to the bottom of angle member 62 (FIG. 6) located at the bottom of each end wall 32,34.

An end sill 70 is located at each end of the car. Each end sill 70 is joined at its ends to side sills 26,28 (FIGS. 3 to 6). Furthermore, each end sill 70 includes a pair of vertically positioned laterally arranged parallel spaced apart plates 72,74 between which vertical spaced apart plates 76 are positioned and joined thereto. A horizontal plate 75 is positioned between and is joined to plates 72,74 near but below the top edge thereof and the outer ends of plate 75 are sloped downwardly to be joined to the top of the top side sills 36 (FIGS. 3 to 5). The lower edge of vertical plate 74 is joined to the top of shear plate 100 and the lower edge portion of vertical plate 72 is joined to the forward lateral edge 102 of shear plate 100. The shear plate 100 forward lateral edge 102 is reinforced by a lateral horizontal plate 104 which terminates in ends 106 located considerably inwardly of the side sills 36. Vertical plate 72 is also joined to plate 104 for further support. A pair of spaced apart side bearing arms 110,112 are mounted on the forward face of plate 72 (FIG. 2).

The rear lateral edge 101 of shear plate 100 is joined to the bottom of a channel member 103 located at the top of each of the well end walls 32,34 which are also joined to a respective channel member 103 (FIG. 6). Near the ends of each channel member 103 a pair of vertical spaced apart reinforcement plates 105 are positioned between the top and bottom flanges of the channel member.

The male coupler 150, and the female coupler 152, at the ends of the car body 24 are each mounted in a stub center sill 120 (FIGS. 3 to 6). Each stub center sill 120 includes a pair of spaced apart substantially identical vertical side walls or plates 122,124. Each side wall 122,124 has a substantially horizontal top 126 extending for about the length of the stub center sill wall, with the top 126 joined to shear plate 100. The rear vertical end 128 of each side wall 122,124 is joined to a well end wall 32,34. The substantially horizontal bottom edge 130 of side walls 122,124 extends forward from near the wall rear end for a distance substantially less than the length of the stub center sill and terminates in an upwardly extending vertical inner edge 132. The stub center sill side walls 122,124 also have a front end or edge 134 extending downward for a distance substantially less than the height of the center sill side wall and terminating in a rearwardly extending horizontal central edge 136. An arced edge 138 extends from the horizontal central edge 136 to the vertical inner edge 132.

A vertical web 140 is centrally spaced between the two stub center sill side walls 122,124. The vertical web 140 largely corresponds in profile to the side walls 122,124 except that its top horizontal edge 142 is not as high as edge 126 and the front edge 144 is cut back so that the coupler 150 or 152 can be inserted between side walls 122,124 and joined thereto. Additionally, the rear upper edge 146 of central web 140 has been slanted.

A horizontal plate 148 is positioned between and joined to the stub center sill side walls 122,124. Plate 148 is also joined to the vertical web 140 top edge 142. A horizontal plate 154 is joined to the bottom edges 130 of side walls 122,124 and web 140. The shear plate 60 extends beneath plate 154 and is joined to it.

A one piece curved angle plate 156 is joined to the vertical inner edges 132, to the rearwardly extending horizontal central edges 136 and to the arced edges 138 of the stub center sill side walls 122,124 and web 140. The forward end of curved plate 156 and the forward end of plate 148 are connected to the bottom and top of the coupler 150 or 152.

Three radial-like gussets 160,162,164 have their lower ends joined to the convex inner surface of the arced or curved portion of plate 156. The top ends of gussets 162,164 are joined to the inner surface of horizontal plate 148. The inner side edges of plates 160,162,164 are joined to plate 140. The outside surfaces of plates 122,124 are provided with three gussets 160A, 162A and 164A which are essentially aligned with plates 160,162,164.

A plate 164B is mounted on top of plate 148 in alignment with plate 164. A vertical plate 168 is positioned between plate 148 and shear plate 100 (FIG. 6).

The described stub center sill is especially suitable for 125 ton capacity well cars for carrying double stack containers, especially articulated cars. The curved plate 156 provides a more even stress distribution in the stub center sill than previous structures, including bent flange designs used previously on 100 ton capacity container cars. It also makes it easier to assemble the car. The one-piece continuous plate 156 eliminates welding on the bottom surface of the stub center sill in the critical high stress area. The addition of the central web plate 140 and the lateral internal stiffeners 160,162,164 provide for a more even distribution of stresses in the bottom flange plate 156, allowing for a reduction in material thickness in plate 156 over the prior stub center sill design having spaced apart longitudinal walls somewhat like walls 122,124 but without the central web 140. Also, it made it possible to reduce the thickness of walls 122,124. The use of thinner plates also made it easier to join them to coupler 150,152 than when thicker plates were needed. The central web plate 140 also provides for a better transfer of load from the stub center sill to the lower shear plate 60. The central web plate 140 need not be connected to the coupler casting so no change in the coupler design is required. Furthermore, the additional load carrying capacity is obtained within the same basic space envelope of the stub center sill used on the prior art 100 ton capacity car design.

The tie-in of a coupler 150 or 152 to the stub center sill 120 is further reinforced by an assembly 170 extending from the top of the coupler to the end sill 70 (FIGS. 5 and 6). The assembly 170 has a pair of spaced apart vertical plates 172,174 positioned longitudinally of the car. Each of the plates 172,174 has a rear vertical edge 176 joined to end sill plate 72 and a bottom horizontal forward edge 178 joined to the top of coupler 150,152. Plate 180 extends laterally between the plate 172,174 and is joined to them. Plate 180 has a top horizontal portion 182 and a forward sloping portion 184. An additional angle plate 186 is joined to the lower edge of plates 172,174. The rear edge of plate 186 is joined to plate 72 and the bottom edge of plate 186 is joined to coupler 150,152. The side edges of plate 186 extend beyond the plates 172,174 a short distance.

The described assembly constitutes a box-like fabrication which is especially suitable for reinforcing the connection of the couplers 150,152 to the stub center sill 120 and to the end sill 70. Also, it provides greater vertical reaction capability than simple gussets. Being a box section, it increases the torsional restraint that the rail car can provide to the coupler. It also provides an additional load path for the lateral car forces to be transferred to the coupler.

The central portion of the car is reinforced so that optionally it can carry two twenty feet long containers in the well instead of one forty feet long container.

With reference to FIGS. 7 to 10, the central portion of the car 20 is provided with a pair of slightly spaced apart channel members comprising vertical ribs 190,192. The open side of the channel members are joined to the outer surface of side wall sheet or plate 42 to thereby effectively form tubular elements. The top of ribs 190,192 is joined to the bottom of top side sill 36. Each of the ribs is of uniform width and depth for its entire height so that they can be called straight ribs. The other ribs 194 along the side walls of the car are tapered and are laterally narrower at the bottom than at the top.

The lower ends of each rib 190,192 has reinforcing plates 196,198 joined to it on opposing sides. The reinforcing plates 196,198 project downwardly beyond the lower end of the ribs and end with an arced convex outer corner (FIG. 9). The plates 196,198 are joined to side wall sheet 42 and to the reinforcing member 200. A plate 208 (FIG. 9) is joined to the inside surface of said wall sheet 42 adjacent ribs 190,192.

The reinforcing member 200 has a longitudinal horizontal flange 202 joined to the bottom of the well lower side sill flange 50 and a longitudinal vertical web 204 joined to the outside surface of ribs 190,192 with the flange 202 and web 204 joined together by an integral unitary arced transition portion 206 (FIG. 9). The curved outer corner of plates 196,198 are joined to transition portion 206.

The described reinforcement of the central portion of the 125 ton car side walls provides greater load carrying capacity than previous designs without exceeding the clearance envelope for the previously known and used 100 ton car. It is especially suitable for carrying two twenty feet long containers end-to-end in the well. Each such container can carry 53,000 pounds in the well.

Reinforcement of the central portions of the side walls 26,28 also makes it possible to carry two containers end-to-end in the well portion without overloading the design strength of the car body. When a single long container is transported in the well only the four lower corners of the container contact the well floor so that one-half of the container load is applied to each end of the well. When two short containers, i.e., twenty foot containers, are placed in a forty foot long well the abutting ends of the containers apply their load to the central portion of the well so that one-half of the load of each equally and uniformly loaded container is applied to the car body central portion. Because of the increased load, the well central portion is reinforced.

The formed plate 200 reinforces the lower side sill angle 38 and increases the bending strength where the containers are supported. The plate 200 is tapered in the longitudinal direction of the side sill to obtain a smooth transition of the high longitudinal side sill angle stresses into the reinforcing plate. The single piece formed plate 200 makes for easier fabrication, less pieces and a stronger connection to the side ribs than did the previous use of two pieces, with one piece inside and the other outside of the well.

The use of straight ribs 190,192 instead of the previously used tapered design provide a better cross section at the bottom side sill area. The ribs 190,192 are desirably positioned so that they are adjacent the container casting support points to provide a stiffer and stronger support. The reinforcement plates 196,198 on the sides of ribs 190,192 provide a continuity of the rib box shape to the bottom of the side sill angle 38 while providing sufficient attachment length to transmit the vertical load and lateral bending moments into the ribs.

The bottom of the car well 300 has twin lateral side-by-side tie braces 212,214 in the central bottom portion of the car well. In addition, single lateral tie braces 216,218 are located approximately in the middle of each half of the well from a well end wall to the twin tie braces.

Figure 8:
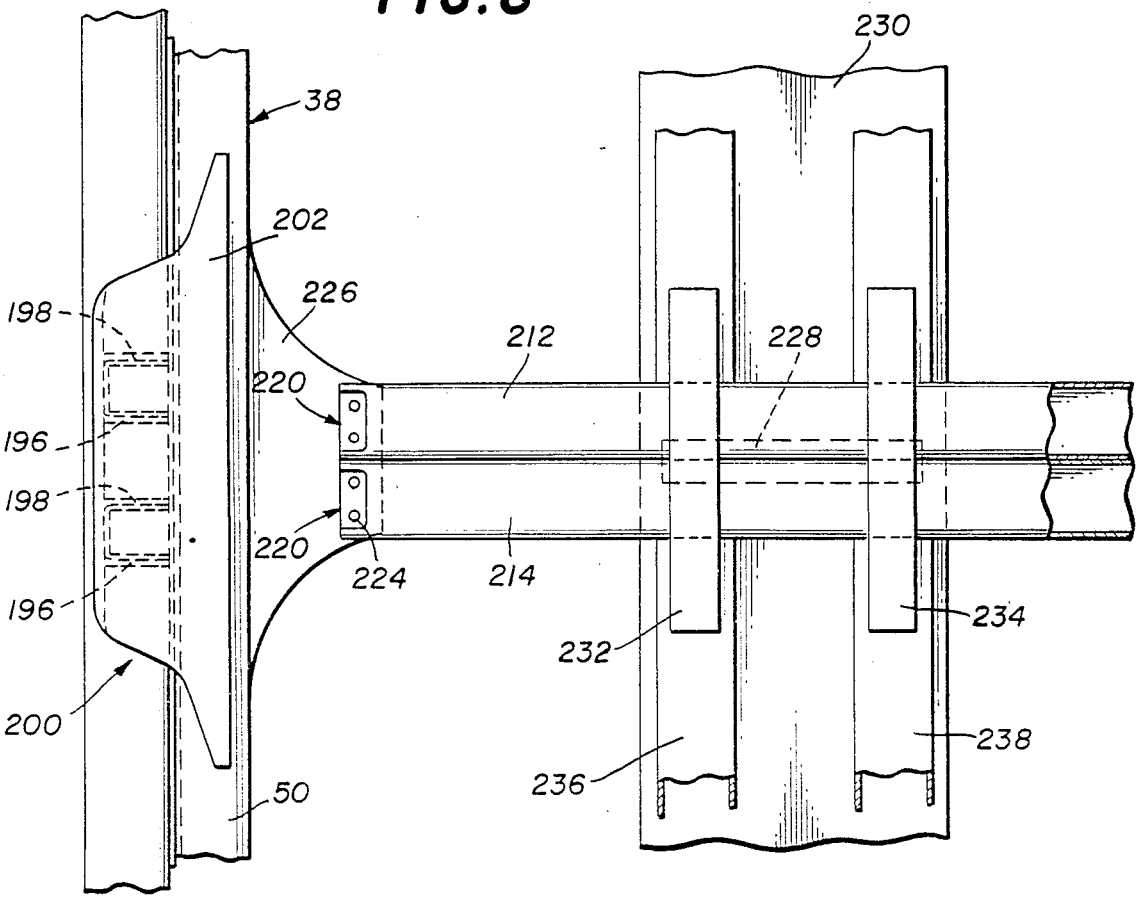
FIG. 8 is a bottom or upwardly looking view of part of the longitudinal central portion of the car as shown in FIG. 2.

The twin tie braces 212,214 are identical tubular members which are welded together along abutting side walls. The lower web of each end of each tie brace 212,214 is cut out to provide an access opening or hole 220 (FIGS. 8 and 9). The openings 220 make it easier for fasteners 224 to be positioned in holes in the top web of each twin tie brace when it is secured to the transition plate 226. Transition plate 226 is welded to the edge of lower side sill flange 50 to secure the tie brace in place.

A strip plate 228 is positioned on top of the joint where the twin tie braces abut each other. Plate 230 extends the full longitudinal length of the well 300 to the shear plates 60 at each end. The plate 230 is supported by and joined to strip plate 228.

Two spaced apart longitudinal strip plates 232,234 are joined to the bottom of twin tie braces 212,214 (FIG. 8). The ends of spaced apart longitudinal channel members 236,238 are supported respectively by plates 232,234 and are joined thereto as well as to the bottom of plate 230.

Each of the single tie braces 216,218 has an access cut out portion 220A at each end in the lower web so that fasteners 224A extending through a transition plate 226A can extend into holes in the top web of the tie brace and be secured in place readily. The transition plates 226A are joined to the adjacent lower side sill flange 50 to complete the tie brace connection between the car well side walls.

Each single lateral tie brace 216,218 has a strip plate 242 on the top in the middle and it supports longitudinal plate 230. The single lateral tie braces 216,218 also have a pair of spaced apart strip plates 232A,234A, like strip plates 232,234, which are connected to the bottom thereof and positioned longitudinal of the car.

By providing the access openings 220,220A in the ends of the tubular tie braces not only is it easier to obtain access to bolts when used as the fasteners but the mating of the adjacent plate surfaces provides a strong joint. Additionally, by letting the vertical walls or flanges of the tie brace ends continue outboard of the fasteners a stiffer lateral tie brace is provided than the tie brace previously used made of a channel member to which a plate was welded and in which the channel shape ended inboard of the fastener connection to provide access to the fastener with the result that it was not as stiff as desired. The new tie braces provided herewith also use fewer pieces and less welding than the old braces. Also, a tube tie brace will have better fatigue characteristics than the old tie brace.

The described car body is noteworthy for its relatively light weight when empty compared to its carrying load. Equally important as its strength is its relatively ease of fabrication. While the car body embodiment illustrated by the drawings employs several novel structural features, it is feasible to use only one or more of such features in a particular car body and, if necessary, to use other structural elements if appropriate.

The foregoing detailed description has been given for clearness of understanding only, and no unnecessary limitations should be understood therefrom, and modifications will be obvious to those skilled in the art.

What is claimed is:

1. A railroad car for transporting a horizontal shipping container comprising:

first and second railroad trucks supporting opposite ends of a railroad car body;

the car body having a well portion, defined in part by low longitudinal side walls and lateral end walls, which supports one or more horizontal longitudinally positioned containers;

a stub center sill at each end of the car body;

each stub center sill being joined at one end to an adjacent well end wall with the other end of the stub center sill having coupler means to couple the car to another car to make up a train;

each stub center sill having a pair of spaced apart substantially identical side walls, each of said sidewalls having a bottom edge extending forward from near the well end wall for a distance substantially less than the length of the stub center sill wall and terminating in an upwardly extending inner edge, a front end extending downward for a distance substantially less than the height of the stub center sill side wall and terminating in a rearwardly extending central edge, and an arced edge extending from the central edge to the inner edge; and a one piece curved angle plate joined to the vertical inner edges, the rearwardly extending central edges and the arced edges of the stub center sill side walls.

2. A railroad car according to claim 1 including:

lateral spaced apart plates between the side walls and the vertical web and joined to the curved angle plate at the curved portion thereof.

3. A railroad car according to claim 1 in which:

each side wall of the car has a top side sill extending beyond the end of the well portion to the end of the car body;

an end sill is at each end of the car body joined to the ends of the top side sills; and a shear plate is positioned on top of and is joined to each stub center sill, end sill, the top side sills and the well portion end wall.

4. A railroad car according to claim 3 in which:

at least one end sill has an outer vertical lateral surface; and a pair of spaces apart vertical plates longitudinal of the car are joined to the end sill outer vertical lateral surface and to the coupler means.

5. A railroad car according to claim 4 in which at least one lateral plate extends between and is joined to the spaced apart vertical plates which are longitudinal of the car.

6. A railroad car according to claim 4 in which the coupler means constitutes a male element of an articulated coupler means, the male element has a top surface and the spaced apart vertical plates which are longitudinal of the car are joined to the top surface of the male element.

7. A railroad car according to claim 4 in which at least two lateral spaced apart plates extend between and are joined to the spaced apart vertical plates which are longitudinal of the car.

8. A railroad car for transporting a horizontal shipping container comprising:

first and second railroad trucks supporting opposite ends of a railroad car body;

the car body having a well portion, defined in part by low longitudinal side walls and lateral end walls, which supports one or more horizontal longitudinally positioned containers;

a stub center sill at each end of the car body;

each stub center sill being joined at one end to an adjacent well end wall with the other end of the stub center sill having coupler means to couple the car to another car to make up a train;

an end sill at at least one end of the car body;

a pair of spaced apart vertical plates longitudinal of the car are joined to the end sill and to the coupler means; and at least one plate extends between and is joined to the spaced apart vertical plates which are longitudinal of the car.

9. A railroad car according to claim 8 in which the coupler means constitutes a male element of an articulated coupler means, the male element has a top surface and the spaced apart vertical plates which are longitudinal of the car are joined to the top surface of the male element.

10. A railroad car according to claim 9 in which at least two lateral spaced apart plates extend between and are joined to the spaced apart vertical plates which are longitudinal of the car.

11. A railroad car for transporting a horizontal shipping container comprising:

first and second railroad trucks supporting opposite ends of a railroad car body;

the car body having a well portion, defined in part by low longitudinal side walls and lateral end walls, which supports one or more horizontal longitudinally positioned containers;

s stub center sill at each end of the car body;

each stub center sill being joined at one end to an adjacent well end wall with the other end of the stub center sill having coupler means to couple the car to another car to make up a train;

each well side wall of the car having a top side sill and a bottom side sill;

the well side walls including a side sheet extending from the top side sill to the bottom side sill;

the well side sills having a vertical web joined to the side sheet and an inwardly directed flange;

a pair of closely spaced apart vertical ribs along the outside surface of the well side wall centrally located longitudinally of the well and joined to the top side sill and to the bottom side sill; and a reinforcing member having a longitudinal horizontal flange joined to the bottom of the well side sill flange and a longitudinal vertical web joined to the outside surface of the ribs, with the flange and web of said member joined together by an integral arced transition portion.

12. A railroad car according to claim 11 in which:

the lower ends of the ribs are reinforced by vertical gusset plates on opposing lateral side surfaces and the said vertical plates are joined to a bottom side sill and to the reinforcing member.

13. A railroad car according to claim 12 in which each rib is an identical straight channel member having all sides with parallel longitudinal edges and the open side of the channel member is joined to the side wall sheet.

14. A railraod car for transporting a horizontal shipping container comprising:

first and second railroad trucks supporting opposite ends of a railroad car body;

the car body having a well portion, defined in part by low longitudinal side walls and lateral end walls, which supports one or more horizontal longitudinally positioned containers;

a stub center sill at each end of the car body;

each stub center sill being joined at one end to an adjacent well end wall with the other end of the stub center sill having coupler means to couple the car to another car to make up a train;

the well side walls having top and bottom side sills extending at least for the length of the well portion;

a plurality of spaced apart lateral bottom side sill rectangular tubular tie braces operatively joined at their ends to opposing bottom side sills;

the tie brace ends having a lower horizontal web cut out to provide access for fasteners to be installed through an upper horizontal web and joined to a plate joined to a bottom side sill.

15. A railroad car according to claim 14 in which two tie braces are positioned side-by-side and they are joined together.

16. A railroad car for transporting a horizontal shipping container comprising:

first and second railroad trucks supporting opposite ends of a railroad car body;

the car body having a well portion, defined in part by low longitudinal side walls and lateral end walls, which supports one or more horizontal longitudinally positioned containers;

a stub center sill at each end of the car body;

each stub center sill being joined at one end to an adjacent well end wall with the other end of the stub center sill having coupler means to couple the car to another car to make up a train;

each stub center sill having a pair of spaced apart substantially identical side walls, each of said side walls having a bottom edge extending forward from near the well end wall for a distance substantially less than the length of the stub center sill wall and terminating in an upwardly extending inner edge, a front end extending downward for a distance substantially less than the height of the stub center sill side wall and terminating in a rearwardly extending central edge, and an arced edge extending from the central edge to the inner edge;

a vertical web spaced between the stub center sill side walls;

a plate between and joined to the stub center sill side walls and joined to the vertical web top portion;

a substantially horizontal plate, joined to the stub center sill side walls and the vertical web, adjacent the bottom edge; and a one piece curved angle plate joined to the vertical inner edges, the rearwardly extending central edges and the arced edges of the stub center sill side walls.

17. A railroad car according to claim 16 including:

lateral spaced apart plates between the side walls and the vertical web and joined to the curved angle plate at the curved portion thereof.

18. A railroad car according to claim 17 including:

lateral spaced apart gussets joined to the outer surface of the side walls.

19. A railroad car according to claim 17 in which the curved angle plate extends beyond the outer surface of the stub center sill side walls.

20. A railroad car according to claim 19 including:

lateral spaced apart gussets joined to the outer surface of the side walls and to the curved angle plate.

21. A railroad car according to claim 16 in which:

the well side walls have top and bottom side sills extending at least for the length of the well portion; and a lateral shear plate is at the bottom of and in the well portion along each end wall and connected to each bottom side sill.

22. A railroad car according to claim 16 in which:

the well side walls have top and bottom side sills;

each top side sill extends beyond the end of the well portion to the end of the car body;

an end sill is at each end of the car body joined to the ends of the top side sills; and a shear plate is positioned on top of and joined to each stub center sill, end sill, the top side sills and the well portion end wall.

23. A railroad car according to claim 22 in which each well portion end wall is reinforced with a flanged structural member extending between and joined to the bottom side sills.

24. A railroad car according to claim 23 in which the top of each well portion end wall is reinforced with a flanged structural member extending between and joined to the top side sills.

25. A railroad car according to claim 22 in which:

at least one end sill has an outer vertical lateral surface; and a pair of spaced apart vertical plates longitudinal of the car are joined to the end sill outer vertical lateral surface and to the coupler means.

26. A railroad car according to claim 25 in which at least one lateral plate extends between and is joined to the spaced apart vertical plates which are longitudinal of the car.

27. A railroad car according to claim 25 in which the coupler means constitutes a male element of an articulated coupler means, the male element has a top surface and the spaced apart vertical plates which are longitudinal of the car are joined to the top surface of the male element.

28. A railroad car according to claim 27 in which at least two lateral spaced apart plates extend between and are joined to the spaced apart vertical plates which are longitudinal of the car.

29. A railroad car according to claim 16 in which:

there are top and bottom side sills along each well side wall;

the well side walls include a side sheet extending from the top side sill to the bottom side sill;

the well side sills have a vertical web joined to the side sheet and an inwardly directed flange;

a pair of closely spaced apart vertical ribs along the outside surface of the well side wall centrally located longitudinally of the well and joined to the top side sill and to the bottom side sill; and a reinforcing member having a longitudinal horizontal flange joined to the bottom of the well side sill flange and a longitudinal vertical web joined to the outside surface of the ribs, with the flange and web of said member joined together by an integral arced transition portion.

30. A railroad car according to claim 29 in which:

the lower ends of the ribs are reinforced by vertical gusset plates on opposing lateral side surfaces and the said vertical plates are joined to the lower side sill and to the reinforcing member.

31. A railroad car according to claim 30 in which each rib is an identical straight channel member having an open side and a pair of opposing sides with parallel longitudinal edges and the open side of the channel member is joined to the side wall plate.

32. A railroad car according to claim 16 including:

top and bottom side sills along each well side wall;

a plurality of spaced apart lateral rectangular tubular tie braces operatively joined at their ends to the bottom side sills;

the tie brace ends having a lower horizontal web cut out to provide access for vertical fasteners to be installed through an upper horizontal web and joined to a plate joined to a bottom side sill.

33. A railroad car according to claim 32 in which two tie braces are positioned side-by-side and they are joined together.

34. A railroad car according to claim 4 in which the coupler means constitutes a female element of an articulated coupler means, the female element has a top surface and the spaced apart vertical plates which are longitudinal of the car are joined to the top surface of the female element.

35. A railroad car according to claim 8 in which the coupler means constitutes a female element of an articulated coupler means, the female element has a top surface and the spaced apart vertical plates which are longitudinal of the car are joined to the top surface of the female element.

36. A railroad car according to claim 25 in which the coupler means constitutes a female element of an articulated coupler means, the female element has a top surface and the spaced apart vertical plates which are longitudinal of the car are joined to the top surface of the female element.

* * * * *